US008734174B2

(12) United States Patent
Nakamura

(10) Patent No.: US 8,734,174 B2
(45) Date of Patent: May 27, 2014

(54) WATERPROOF CONNECTOR HAVING AN INTEGRALLY FORMED ELASTIC SEAL MEMBER

(75) Inventor: Masatoshi Nakamura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/202,505

(22) PCT Filed: Feb. 18, 2010

(86) PCT No.: PCT/JP2010/052476
§ 371 (c)(1),
(2), (4) Date: Aug. 19, 2011

(87) PCT Pub. No.: WO2010/095697
PCT Pub. Date: Aug. 26, 2010

(65) Prior Publication Data

US 2011/0300731 A1 Dec. 8, 2011

(30) Foreign Application Priority Data

Feb. 20, 2009 (JP) ..... 2009-038101
May 14, 2009 (JP) ..... 2009-117649

(51) Int. Cl.
*H01R 13/52* (2006.01)

(52) U.S. Cl.
USPC ..... 439/271

(58) Field of Classification Search
USPC ..... 439/271–275, 587, 364
See application file for complete search history.

(56) References Cited

U.S. PATENT DOCUMENTS

| | | | | |
|---|---|---|---|---|
| 5,580,264 | A * | 12/1996 | Aoyama et al. | 439/275 |
| 5,613,868 | A | 3/1997 | Ohsumi et al. | |
| 5,931,699 | A | 8/1999 | Saito et al. | |
| 6,371,807 | B1 | 4/2002 | Takagishi et al. | |
| 6,450,823 | B1 * | 9/2002 | Ichio et al. | 439/275 |
| 7,201,595 | B1 * | 4/2007 | Morello | 439/271 |
| 8,414,312 | B2 * | 4/2013 | Hung et al. | 439/108 |
| 2004/0092163 | A1 | 5/2004 | Nagayasu et al. | |

FOREIGN PATENT DOCUMENTS

| | | | |
|---|---|---|---|
| JP | 7-320811 | A | 12/1995 |
| JP | 9-289057 | A | 11/1997 |
| JP | 2000-21491 | A | 1/2000 |
| JP | 2004-158316 | A | 6/2004 |
| JP | 2006-66208 | A | 3/2006 |
| JP | 2006-66217 | A | 3/2006 |
| JP | 2008-300318 | A | 12/2008 |
| WO | 2011/096548 | A1 | 8/2011 |

OTHER PUBLICATIONS

International Search Report (PCT/ISA/210) issued on Mar. 30, 2010 in the International Patent Application No. PCT/JP2010/052476.

(Continued)

*Primary Examiner* — Chandrika Prasad
(74) *Attorney, Agent, or Firm* — Sughrue Mion, PLLC

(57) ABSTRACT

A waterproof connector has a first housing and a seal member. The first housing has an accommodation chamber which accommodates a terminal attached to an electric wire and a rear wall which defines part of the accommodation changer and has an insertion hole. The seal member has a terminal hole into which the terminal is inserted, is formed integrally with the first housing and is formed of an elastic material so as to be secured tight to an outer circumference of the electric wire.

16 Claims, 13 Drawing Sheets

(56) References Cited

OTHER PUBLICATIONS

Extended Search Report dated Nov. 16, 2012, issued by the European Patent Office in counterpart European Patent Application No. 10743823.6.

Office Action issued Jun. 21, 2013 from the State Intellectual Property Office of P.R. China in counterpart Chinese application No. 201080008638.X.

* cited by examiner

Prior Art

Prior Art

WATERPROOF CONNECTOR HAVING AN INTEGRALLY FORMED ELASTIC SEAL MEMBER

TECHNICAL FIELD

The present invention relates to a waterproof connector including an integral mat seal which prevents water from entering an interior of a connector housing.

BACKGROUND ART

Patent Document 1 proposes a conventional waterproof connector. As is shown in FIG. 19, this waterproof connector 1100 includes a plurality of terminal accommodation chambers where a plurality of female metal terminals 1102 are individually accommodated in a connector housing 1101 which is formed of a synthetic resin, and each female metal terminal 1102 can be inserted into each terminal accommodation chamber from a rear end of the connector housing 1101 in such a state that the female metal terminal 1102 is crimped to a leading end of an electric wire 1104. An insertion hole 1105 is provided in the rear end of the connector housing 1101, and an integral mat seal (a rubber plug) which is formed of an elastic material is inserted in the insertion hole 1105. This mat seal 1106 includes a front housing seal portion 1106*a* which projects to an outer circumferential side and is held by a seal setting portion (a rubber plug holder) 1107 which is installed in the rear end of the connector housing 1101. A plurality of terminal holes are provided in the mat seal 1106 in positions which confront the terminal accommodation chambers in the connector housing 1101 so that electric wires 1104 are inserted therethrough. A lip 1109 is provided circumferentially on an inner circumferential surface of each terminal hole so as to be tightly secured to an outer circumferential surface of the electric wire 1104. Thus, gaps defined between the electric wires 1104 and the connector housing 1101 are sealed by the mat seal 1106 which includes the lips 1109 so as to prevent the entering of water.

In the configuration described above, firstly, the mat seal 1106 is inserted into the insertion hole 1105 in the rear end of the connector housing 1101, and the seal setting portion 1107 is installed in the rear end of the connector housing 1101 so as to hold the mat seal 1106. As this occurs, the front housing seal portion 1106*a* of the mat seal 1106 is accommodated in a groove portion 1101*a* at the rear end of the connector housing 1101, and the seal setting portion 1107 is brought into press contact with a rear end of the front housing seal portion 1106*a*, whereby the mat seal 1106 is held in an elastically compressed state. However, the mat seal 1106 is not bonded to the connector housing 1101 and the seal setting portion 1107. Following this, the leading end of the electric wire 1104 is inserted into the female metal terminal 1102, which is then crimped onto the leading end of the electric wire 1104. Thereafter, the metal terminal 1102 is inserted into the terminal accommodation chamber 1 from a rear end side of the connector housing 1101, so that the electric wire 1104 is disposed in such a state that the electric wire 1104 extends rearwards of the metal terminal 1102 and is inserted through the terminal hole 1 in the mat seal 1106. Following this, a male metal terminal (not shown) of a mating connector housing is inserted into the terminal accommodation chamber 1 in the connector housing 1101 from a distal end side, whereby the electric wire 1104 and a mating electric wire are electrically connected together. When the waterproof connector 1100 is built up in this way, the mat seal 1106 is inserted into the insertion hole 1105 in the rear end of the connector housing 1101, and the outer circumferential surface 1109 of the electric wire 1104 which is inserted into the terminal hole 1 in the seal mat 1106 is elastically and tightly secured to the lip 1109. Therefore, water or the like can be prevented from entering the interior of the connector housing 1101. In addition, gaps defined between the electric wire and a mat seal (not shown) is sealed so as to prevent the entering of water in the mating connector housing.

In addition, for example, Patent Document 2 also describes a conventional waterproof connector.

As is shown in FIG. 20, this waterproof connector 2100 includes a plurality of terminal chambers 2111 which accommodate individually a plurality of terminals 2102 within a connector housing 2110 which is formed of a hart resin material, and each terminal 2102 is inserted into the corresponding terminal accommodation chamber 2111 from a rear end of the connector housing 2110 in such a state that the terminal 2102 is crimped to be joined to a leading end of an electric wire W.

A mat seal 2130 is installed in a rear end of the connector housing 2110, which mat seal 2130 is formed of an elastic material and has through holes 2131 which correspond to the terminal accommodation chambers 2111. Then, a rear holder 2120 is provided behind the mat seal 2130, whereby the mat seal 2130 is interposed between a rear end face of the connector housing 2110 and the rear holder 2120 in a compressed state.

In addition, guide cylindrical portions 2132 are provided at a front end of the mat seal 2130 so as to extend from the corresponding through holes 2131, and the guide cylindrical portions 2132 are inserted into rear end entrances of the terminal accommodation chambers 2111, whereby the terminals 2102 and the electric wires W can be inserted smoothly to the terminal accommodation chambers 2111 through the through holes 2131 in the mat seal 2130 even in the event that a slight positional misalignment exists between the through holes 2131 in the mat seal 2130 and the terminal accommodation chambers 2111 in the connector housing 2110.

RELATED ART DOCUMENT

Patent Document

Patent Document 1: JP-A-2006-66208
Patent Document 2: JP-A-2008-300318

SUMMARY OF INVENTION

Technical Problem

Incidentally, in the conventional waterproof connector 1100 described above, when the electric wires 1104 are inserted one by one into the terminal accommodation chambers 1 from the rear end side of the connector housing 1101, a partial strain is generated in the mat seal 1106 due to the elastic force of the mat seal 1106 itself. Therefore, the mat seal 1106 is shifted in a direction in which the mat seal 1106 is spaced away from the electric wires 1104 inserted, as a result of which the metal terminals 1102 and the electric wires 1104 are inserted in an inappropriate state in which the terminal holes of the mat seal 1106 are shifted from the predetermined positions. Thus, there are caused problems that the lips 1109 of the mat seal 1106 are damaged to reduce the waterproofness and that the insertion of the metal terminals 1102 and the electric wires 1104 into the corresponding terminal holes in the mat seal 1106 becomes difficult.

In addition, the metal terminals 1102 have the directionality and the circumferential rotational position about the axis thereof is specified. Therefore, the metal terminals 1102 and the electric wires 1104 need to be inserted one by one into the terminal accommodation chambers from the rear end side of the connector housing 1101 as has been described above.

Incidentally, in the conventional waterproof connector 2100 described above, the guide cylindrical portions 2132 are inserted into the rear end entrances of the terminal accommodation chambers 2111. Therefore, although the effect of the positional misalignment can be solved to some extent, there is a possibility that the insertion resistance of the terminals 2102 is increased excessively due to there being permitted no outward escape of the guide cylindrical portions 2132 when the terminals 2102 are so inserted.

Then, this invention is intended to provide a waterproof connector which can prevent a positional misalignment of a mat seal by holding the mat seal in a stable fashion so as to further ensure the prevention of entry of water into a connector housing and which can realize an increase in working efficiency in inserting metal terminals and electric wires into the connector housing.

In addition, the invention is also intended to provide a waterproof connector which can restrict a positional misalignment between terminal accommodation chambers in the housing and through holes in the mat seal so as not only to enable the smooth insertion of the terminals into the terminal accommodation chambers but also to suppress an increase in insertion resistance of the terminals.

Solution to Problem

A waterproof connector of the invention comprises a first housing and a seal member. The first housing has an accommodation chamber for accommodating a terminal attached to an electric wire and a rear wall which defines part of the accommodation chamber and has an insertion hole. The seal member has a terminal hole into which a terminal is inserted, is formed integrally with the first housing, is formed of an elastic material and is tightly secured to an outer circumference of the electric wire.

Preferably, the seal member may be formed of a selective adhesion material which exhibits an adhesive force to a material of the first housing and exhibits no adhesive force to a material of which a mold is made. The seal member is molded through two-color molding with the first housing or insert molding relative to the first housing, by using the mold.

Preferably, the seal member may have a rear end face which is bonded to an inner surface of the rear wall which faces the accommodation chamber and an insertion portion which projects from the rear end face. The insertion portion is bonded to an inner circumferential surface of the insertion hole.

Preferably, the insertion portion may have a flange portion which extends towards an outer side of the insertion hole on an outer surface of the rear wall which is opposite to the inner surface thereof. The flange portion is formed integrally with the insertion portion.

Preferably, the waterproof connector of the invention may comprise further a second housing which is formed so as to have a plurality of accommodation holes into which a plurality of terminals like the terminal are accommodated and which has a seal setting surface which faces the rear wall. The first housing has the insertion hole and other insertion holes, and the plurality of insertion holes correspond to the accommodation holes. The seal member is interposed between the rear wall and the seal setting surface and has a contact surface which is brought into contact with the seal setting surface. The contact surface is formed so as to have a plurality of through holes which respectively communicate with the accommodation holes and the insertion holes. A first positioning member is formed on an outer circumference of at least one through hole of the plurality of through holes in the contact surface. The second housing has a second positioning member which is provided on the periphery of the accommodation hole which communicates with the through hole on the outer circumference of which the first positioning member is formed and which is brought into engagement with the first positioning member.

Preferably, the plurality of accommodation holes and the plurality of through holes may be aligned at constant intervals into straight lines in a plurality of rows. The first positioning member may be disposed so as not to lie adjacent to another first positioning member. The second positioning member is disposed so as to correspond to the plurality of first positioning members.

Preferably, the first positioning member may be a circular recess portion. The second positioning member is a cylindrical projecting portion and fits in the corresponding first positioning member.

Preferably, an inner circumferential surface of the projecting portion may be continuous with an inner circumferential surface of the accommodation hole on which the projecting portion is provided and an inner circumferential surface of the through hole which communicates with the accommodation hole.

Preferably, the accommodation chamber may be defined by the rear wall and a hood portion which extends from an outer circumferential edge of the rear wall and which has a cylindrical shape. The second housing is disposed so as to define an annular space between an outer circumferential surface of the second housing and an inner circumferential surface of the hood portion. A projection is provided on an outer circumference of the seal member so as to be tightly secured to a housing of a mating connector which is inserted into the annular space.

Advantageous Effects of Invention

According to the invention, when the terminal and the electric wire are inserted into the accommodation chamber from the end portion of the first housing via the insertion hole in the seal member, a partial strain is generated in the seal member by the elastic force of the seal member itself. However, since the seal member is two-color molded or insert molded, the seal member is bonded to the first housing without forming any gap. Therefore, the seal member is held in the first housing in a more stabilized state, thereby making it possible to prevent a positional misalignment of the seal member. By the prevention of the positional misalignment, the seal member can be restrained from being damaged by the terminal and electric wire, which is true in the conventional waterproof connector. Thus, the entry of water into the first housing can be prevented in a more ensured fashion. In addition, the terminal and the electric wire can be inserted smoothly into the insertion hole in the seal member, and therefore, there can be realized an increase in working efficiency in inserting the metal terminal and the electric wire into the first housing.

In addition, the rear end face of the seal member is bonded to the inner surface of the rear wall of the first housing, and the insertion portion of the seal member is bonded to the inner circumferential surface of the insertion hole in the first housing. Therefore, the bonding area of the seal member with the first housing can be increased, thereby making it possible to realize an increase in the effect of preventing the positional misalignment of the seal member.

Further, the flange portion provided at the distal end of the seal member is bonded to the outer side of the circumferential edge portion of the insertion hole in the outer circumferential surface of the first housing, whereby the bonding area of the flange portion with the first housing can be increased further, thereby making it possible to realize a further increase in the effect of preventing the positional misalignment of the seal member.

According to the invention, the cylindrical projecting portion formed on the seal setting surface of the second housing is fitted in the circular recess portion formed in the opening portion in the through hole in the seal member, thereby making it possible to cause the through hole in the seal member and the accommodation hole in the second housing to communicate with each other while restricting the positional misalignment between the through hole in the seal member and the accommodation hole in the second housing. As this occurs, the circular recess portion on the seal member side fits on an outer circumference of the cylindrical projecting portion on the second housing side. Thus, even in the event that a deformation is generated in the seal member when the terminal and the electric wire are passed through the through hole in the seal member, the effect of the deformation is not transmitted to an interior of the cylindrical projecting portion, and therefore, the terminal and the electric wire can be inserted as deep as the accommodation hole in the second housing while being guided on the inner circumference of the cylindrical projecting portion. Consequently, being different from the conventional waterproof connector in which the positional misalignment is prevented by inserting the cylindrical portion of the seal member into the interior of the accommodation hole, the increase in insertion force generated when the terminal and the electric wire are inserted can be suppressed. In addition, due to the restriction of the positional misalignment, the seal member can be prevented from being damaged by the terminal and the electric wire. Therefore, the water stopping capability can be increased. In addition, the terminal and the electric wire can be inserted smoothly as deep as the insertion hole, and therefore, an increase in terminal inserting capability can be realized. Additionally, the seal member is integrated with the first housing in advance, and therefore, the seal member can be held in a stable fashion, thereby making it possible to combine smoothly the first housing, the second housing and the seal member together.

In addition, the through hole on the seal member side and the accommodation hole on the second housing side can be connected smoothly continuously with each other without forming any step portion therebetween, thereby making it possible to implement a smooth insertion of the terminal and the electric wire.

Additionally, the plurality of circular recess portions are provided at constant intervals so as not to lie adjacent to each other, and therefore, the accommodation holes can be aligned at a narrow pitch while avoiding interference with the adjacent circular recess portion and the cylindrical projecting portion.

In addition, the first housing is configured as an outer housing having the hood portion, and the second housing as an inner housing which is protected inside the hood portion. Therefore, the fitting with a mating connector housing can be performed smoothly. In addition, in the state in which both the connector housing are fitted together, the projection of the seal member seals the gap between the mating connector housing and the inner housing to stop the entry of water thereinto, and therefore, the connecting space where the terminals in the interior of the mating connector housing and the terminals in the interior of the first housing are connected together can be sealed to stop the entry of water thereinto in an ensured fashion.

BRIEF DESCRIPTION OF DRAWINGS

FIG. 1 is viewed from the direction indicated by the arrow A2.

FIG. 1 is viewed from the direction indicated by the arrow A1.

DESCRIPTION OF EMBODIMENTS

Figure 1:
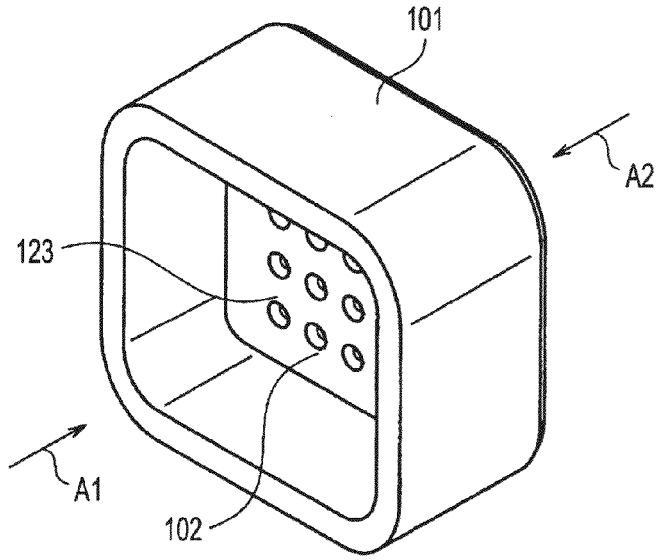
FIG. 1 is a perspective view showing a first embodiment of the invention in which a mat seal is molded integrally with a connector housing of a waterproof connector.
Figure 2:
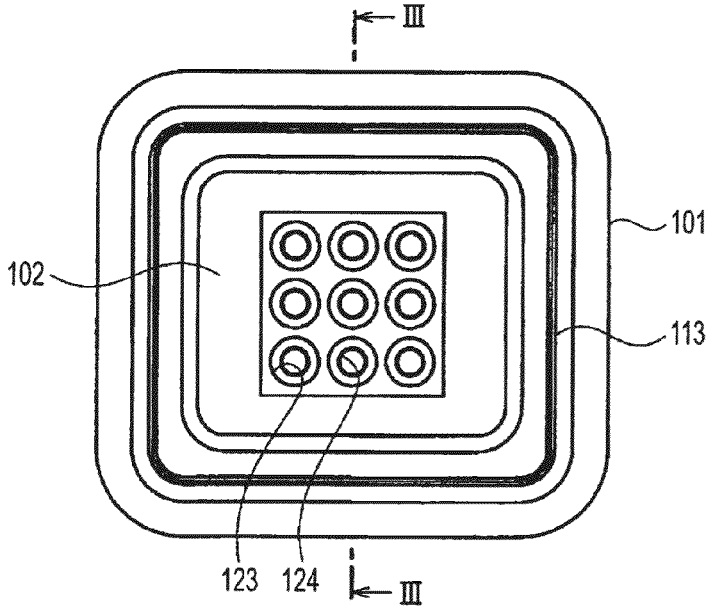
FIG. 2 is a view of the connector housing of the first embodiment of the invention which results when viewed in a direction indicated by an arrow A1 in FIG. 1.
Figure 3:
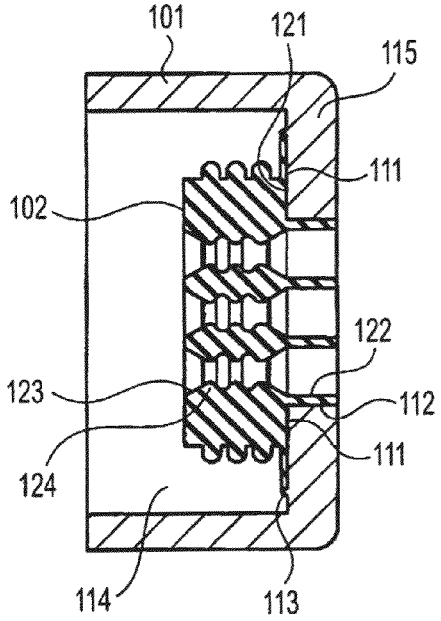
FIG. 3 is a sectional view of the connector housing of the first embodiment of the invention taken along the line III-III in FIG. 2.
Figure 4:
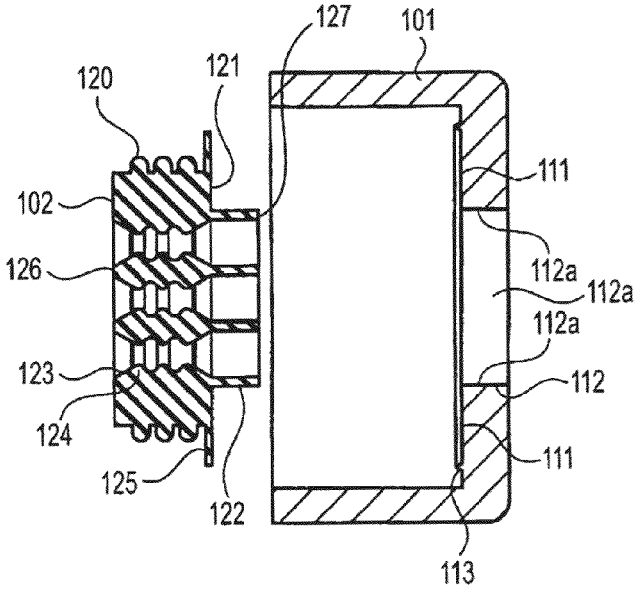
FIG. 4 is a sectional view of the connector housing of the first embodiment of the invention with the mat seal removed from the connector housing.
Figure 5:
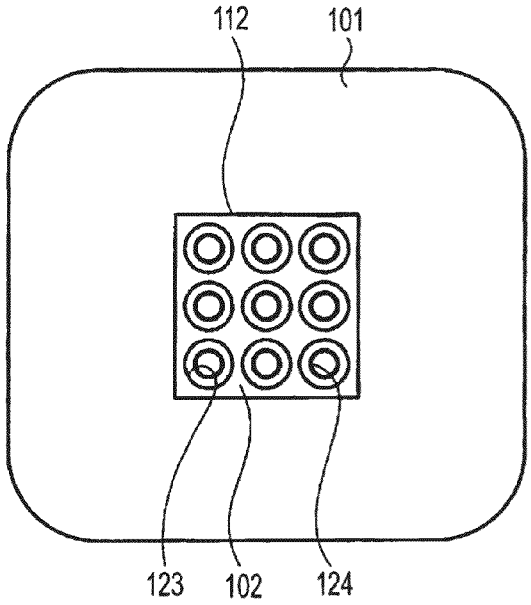
FIG. 5 is a view of the connector housing with the mat seal of the first embodiment of the invention which results when the perspective view of the connector housing with the mat seal is viewed in a direction indicated by an arrow A2.
Figure 6:
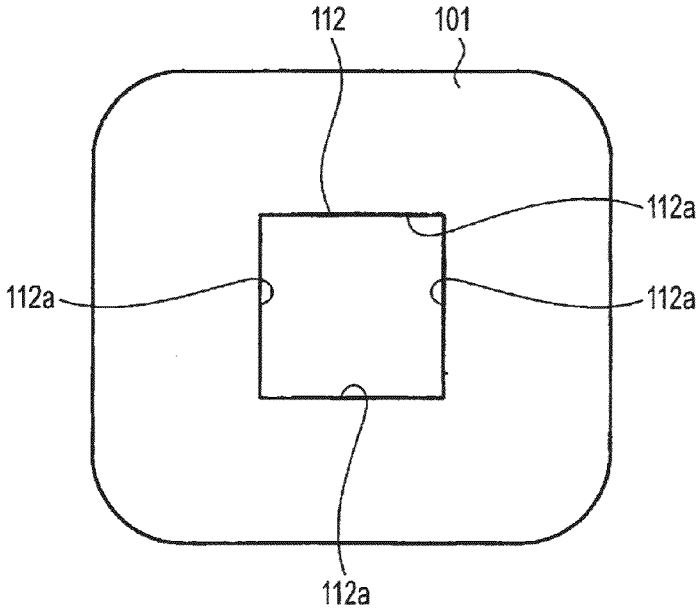
FIG. 6 is a view of the connector housing alone of the first embodiment of the invention which results when
Figure 7:
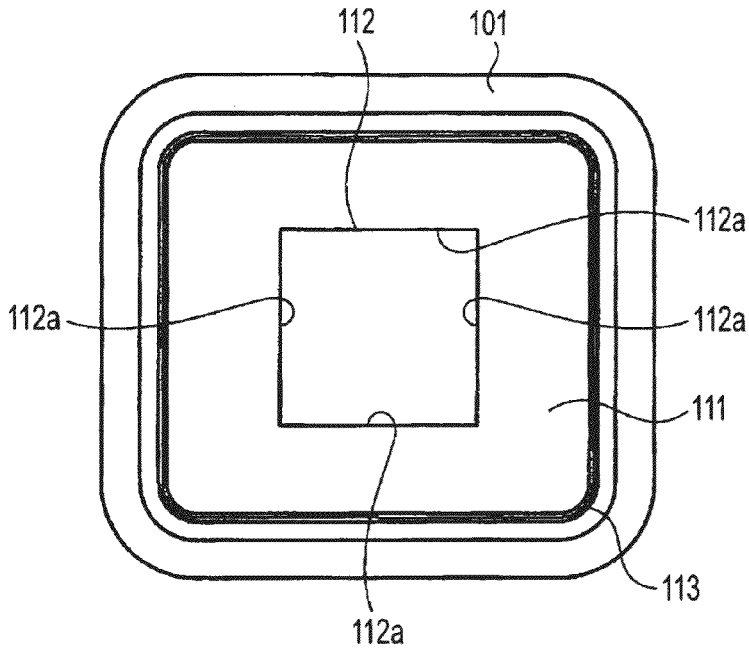
FIG. 7 is a view of the connector housing alone of the first embodiment of the invention which results when
Figure 8:
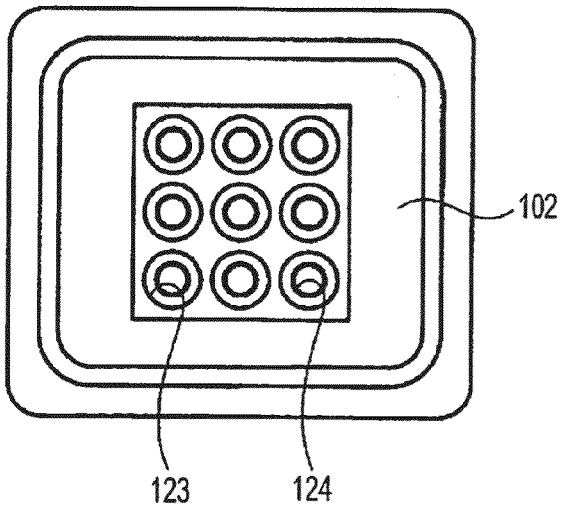
FIG. 8 is a front view of a mat seal of the first embodiment of the invention.

Hereinafter, embodiments of the invention will be described by reference to the drawings. FIGS. 1 to 8 show a first embodiment of the invention. A waterproof connector of the first embodiment includes a connector housing 101 (a first housing) and a mat seal 102 (a seal member).

The connector housing 101 has a substantially box shape which is opened at a front side, and a terminal accommodation chamber 114 is formed in an interior thereof. In addition, an insertion hole 112 is formed in a central portion of a rear wall 115 of the connector housing 101 so as to penetrate through the central portion in a rectangular shape. A triangular projection 113 having a substantially triangular section is provided to project on an inner surface of the rear wall 115 of the connector housing 101 so as to surround the insertion hole 112. The connector housing 101 is molded through an injection molding in which a molten polyamide resin is poured into a mold.

The mat seal 102 is molded through two-color molding on the molded connector housing 101 and is tightly secured to a contact surface (e.g., inner joining surface 111) of the connector housing 101 without any gap formed therebetween by making use of the connector housing 101 as part of the mold. In addition, the mat seal 102 is molded by use of a material having a selective adhesion which exhibits an adhesive force to the polyamide resin of which the connector housing is formed but does not exhibit any adhesive force to a metallic material (chromium) of which the injection molding mold is made, and this type of materials are commercially available including the "Polyamide Resin Liquid Silicone Rubber Selective Adhesion Material" (Product No. X-34-1625A/B, hereinafter, referred to as a "selective adhesion material") produced by Shin-Etsu Chemical. Therefore, the mat seal 102 is bonded to the connector housing 101 at the same time as it is molded.

The mat seal 102 includes a main body portion 120 having a substantially rectangular parallelepiped shape and an insertion portion 122 having a substantially rectangular parallelepiped shape which extends rearwards from a rear end face 121 of the main body portion 120. A frame portion 125 is provided integrally on the rear end face 121 of the main body portion 120 so as to extend along an outer circumferential edge of the rear end face 121. A plurality of terminal holes 123 are provided in the mat seal 102 which extend therethrough from a front end face 126 of the main body portion 120 to a rear end face 127 of the insertion portion 122. Metal terminals (not shown) provided at end portions of electric wires (not shown) are inserted through these terminal holes 123.

A portion of the terminal hole 123 which passes through the insertion portion 122 is formed larger in diameter than an outside diameter of the electric wire so as to realize an increase in workability in insertion of the metal terminal and the electric wire. In addition, a lip 124 (a projection), which can elastically be secured tight to an outer circumferential surface of the electric wire, is provided circumferentially on an inner circumferential surface of a portion of the terminal hole 123 which passes through the main body portion 120, whereby gaps defined between the electric wires and the connector housing 101 are sealed by the mat seal 102 having the lips 124 so as to prevent the entry of water into the connector housing 101.

The rear end face 121 and the frame portion 125 of the mat seal 102 are bonded to an inner joining surface 111 which is set on an area defined between the triangular projection 113 on the inner surface of the rear wall 115 of the connector housing 101 and the insertion hole 112. In addition, the insertion portion 122 is inserted into the insertion hole 112 in the connector housing 101, and an outer circumferential surface of the insertion portion 122 is bonded to an inner circumferential surface 112*a* of the insertion hole 112.

As a fabrication procedure of this waterproof connector, firstly, a molten polyamide resin is poured into the mold so as to mold the connector housing 101. Following this, when the polyamide resin of the connector housing 101 sets, a mold for molding the terminal accommodation chamber 114 of the connector housing 101 and a mold for forming an outer side of the rear wall 115 are replaced by a mold for molding the mat seal 102, and the selective adhesion material which is melted is poured into the mold.

Here, a melting point of the polyamide resin of which the connector housing 101 is formed is set to become higher than a melting point of the selective adhesion material, and therefore, there is caused no such situation that the connector housing 101 is melted when the two-color molding is carried out in the procedure described above. In addition, the selective adhesion material exhibits no adhesive force to the metal of which the mold is made, and therefore, the bonded portion between the connector housing 101 and the mat seal 102 is not damaged. Thus, the connector housing 101 and the mat seal 102 are removed from the molds in such a state that the rear end face 121 and the frame portion 125 of the mat seal 102 are bonded to the inner joining surface 111 of the connector housing 101 and the insertion portion 122 which extends rearwards from the rear end face 121 is bonded to the inner circumferential surface 122*a* of the insertion hole 112.

The connector housing 101 and the mat seal 102 which are molded together are obtained in the way described above and leading ends of electric wires are inserted into metal terminals to be clamped by the metal terminals which are crimped. Thereafter, the metal terminals are inserted into the terminal accommodation chamber from a rear end side of the connector housing 101 and the electric wires are disposed so as to extend rearwards of the metal terminals, so that the metal terminals are inserted through the terminal holes 123. Following this, a mating connector housing (not shown) is inserted into an opening portion at a front side of the connector housing 101, and mating metal terminals (not shown) are inserted into the terminal accommodation chamber in the connector housing 101 from leading end sides thereof so as to be fitted together with the metal terminals, whereby the electric wires and mating electric wires are electrically connected together.

When the waterproof connector is built up in the way described above, the mat seal 102 is inserted into the insertion hole 112 in the rear end of the connector housing 101, and the outer circumferential surfaces of the electric wires which are inserted through the terminal holes 123 in the mat seal 102 are elastically secured tight to the lips 124, thereby making it possible to prevent water or the like from entering an interior of the connector housing 101. In addition, in the mating connector housing, gaps defined between the mating electric wires and a mating connector housing are sealed by a map seal (not shown) so as to prevent the entry of water into the mating connector housing.

Thus, according to the waterproof connector of the first embodiment, when the metal terminals and the electric wires are inserted one by one into the terminal chamber from the rear of the connector housing 101 via the terminal holes 123 in the mat seal 102, a partial strain is generated in the mat seal 102 due to an elastic force generated in the seal mat 102 itself. However, the mat seal 102 is bonded to the connector housing 101, and therefore, the mat seal 102 can be held to the connector housing 101 in a more stabilized fashion, thereby making it possible to prevent a positional misalignment of the mat seal 102.

By this configuration, the damage to the mat seal 102 by the metal terminals and the electric wires can be suppressed which occurs in the conventional waterproof connector when the mat seal 102 is erroneously shifted. Therefore, the entry of water into the interior of the connector housing can be prevented in a more ensured fashion, and the metal terminals and the electric wires can be inserted smoothly into the terminal holes 123 in the mat seal 102. Thus, the efficiency with which the metal terminals and the electric wires are inserted into the connector housing 101 can be increased.

In addition, in the waterproof connector of the first embodiment, the rear end face 121 of the mat seal 102 is bonded to the inner joining surface 111 of the connector housing 101, and the insertion portion 122 of the mat seal 102 is inserted into the insertion hole 112 in the connector housing 101 so as to be bonded to the inner circumferential surface 112*a* of the insertion hole 112. Therefore, the bonding area between the mat seal 102 and the connector housing 101 can be increased, thereby making it possible to realize an increase in the effect of prevention of the positional misalignment of the mat seal 102.

In addition, in the waterproof connector of the first embodiment, the connector housing 101 and the mat seal 102 can be molded together so as to be bonded to each other. This obviates the necessity of applying a primer for adhesion which is required in the conventional waterproof connector, and therefor, time conventionally required for application and drying of the primer can be saved, and variation in adhesion can be eliminated which would be generated due to unevenness of application and dried conditions of the primer. Consequently, in this respect, too, the working efficiency can also be increased.

Further, in the waterproof connector, the provision of the frame portion 125 increases the bonding area with the connector housing 101, thereby making it possible to realize a further increase in the effect of prevention of the positional misalignment of the mat seal 102.

Figure 9:
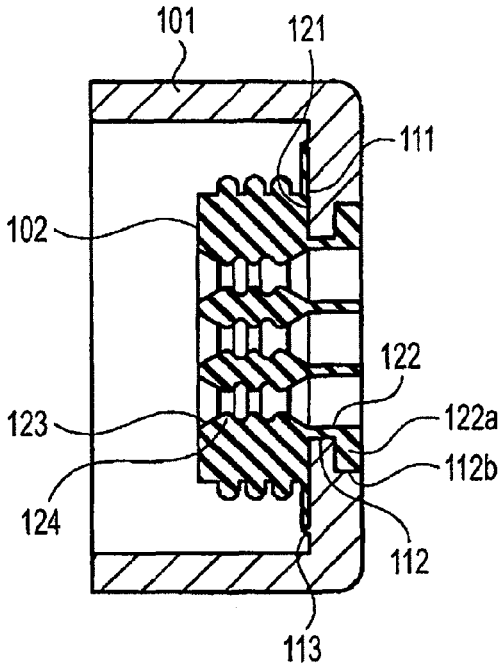
FIG. 9 is a sectional view of a connector housing of a waterproof connector of a modified example of the first embodiment of the invention in which a mat seal is molded integrally with the connector housing.

FIG. 9 shows a modified example of the first embodiment of the invention and is a sectional view of a connector housing 101*a* and a mat seal 102*a* of a connector housing of a waterproof connector which are molded together. In FIG. 9, like reference numerals are given to like constituent components to those described in FIGS. 1 to 8.

In the connector housing 102*a* of the modified example, in addition to the configuration of the connector housing 101 of the first embodiment, a large diameter portion 112*b* which is made up of a recess portion which is formed into a rectangular shape larger by one size than a rectangular shape of an insertion hole 112 is formed on an outer surface side of a rear wall 115 and an outer side of a circumferential edge of the insertion hole 112.

In addition, a flange-like collar portion 122*a* (a flange portion) which projects into the collar receiving portion 112*b* of the connector housing 101*a* is formed integrally with the insertion hole 112 at a rear end of an insertion portion 122 of the mat seal 102. This collar portion 122*a* is molded together with the mat seal 102*a* by implementing a two-color molding on the connector housing 101 molded, and by making use of the connector housing 101 as part of the mold, the collar portion 122*a* is secured tight to a contact surface of the collar receiving portion 112*b* of the connector housing 101 without any gap formed therebetween.

Thus, according to the waterproof connector of the modified example, by bonding the flange-like collar portion 122*a* provided at the rear end of the insertion portion 122 of the mat seal 102 to the collar receiving portion 112*b*, a bonding area of the collar portion 122*a* with the connector housing 101 can be increased further than only with the insertion portion 122, thereby making it possible to realize a further increase in the effect of prevention of a positional misalignment of the seal mat.

FIGS. 10 to 18 show a second embodiment of the invention. As is shown in FIGS. 10 to 18, this waterproof connector 201 includes an inner housing 220 (a second housing) which is formed of a hard synthetic resin material, an outer housing 210 (a first housing) which is formed of a hart synthetic resin material and a mat seal 230 (a seal member) which is formed of an elastic material such as rubber.

A plurality of terminal accommodation chambers 223 (accommodation holes) is provided in a prism-like housing main body 221 of the inner housing 220 so that a terminal 202 attached to a leading end of an electric wire W can be inserted thereinto from a rear end thereof. A rear end face of the housing main body 221 in which rear ends of the plurality of terminal accommodation chambers 223 are opened is made into a seal setting surface 228 to which a front end face 238 of the mat seal 230 is secured tightly.

The outer housing 210 has a cylindrical hood portion 211 which extend forwards and a rear wall 212 which closes a rear end of the hood portion 211. The rear wall 212 is a wall which confronts the seal setting surface 228 of the inner housing 220, and insertion holes 213 are formed in this rear wall 212 so as to correspond to the terminal accommodation chambers 223 in the inner housing 220. These insertion holes 213 are set to a size which enables the smooth passage of the terminal 202 and the electric wire W.

Figure 13:
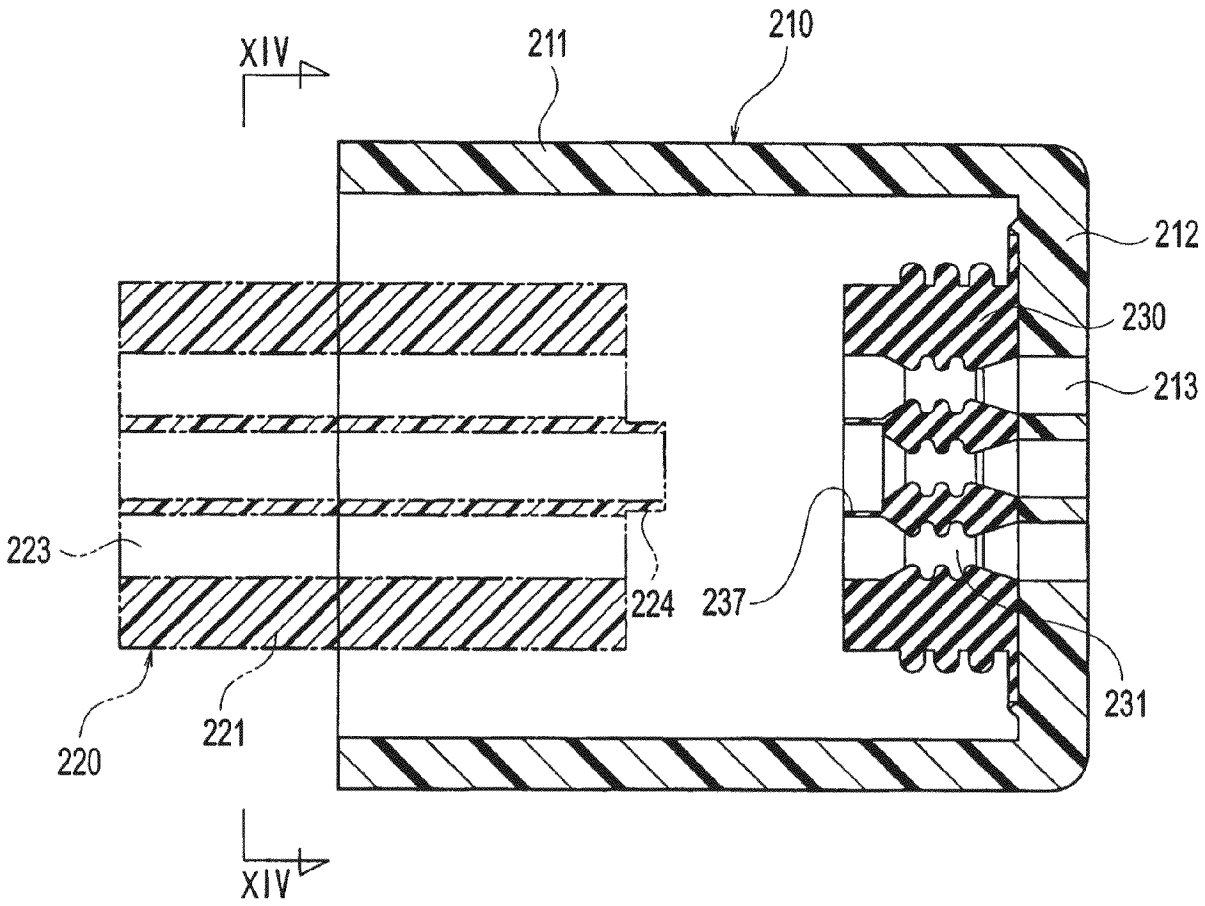
FIG. 13 is a side sectional view of the connector housing of the waterproof connector according to the second embodiment of the invention which shows an assembled state of an outer housing and a mat seal before an inner housing is installed.
Figure 14:
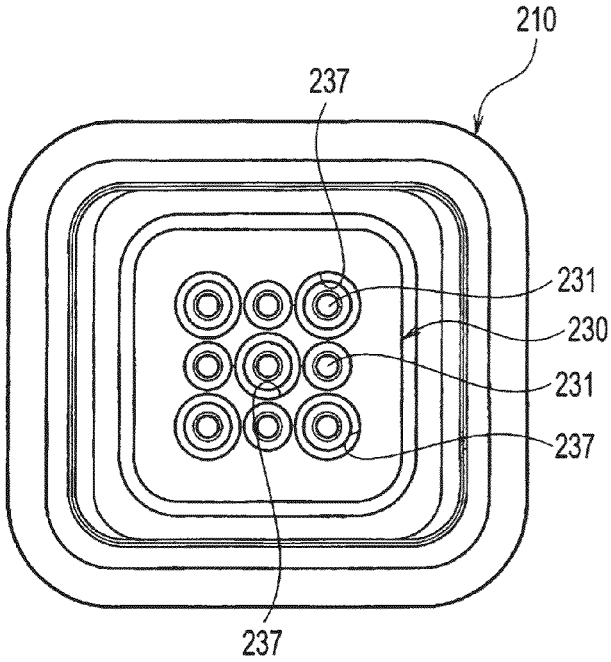
FIG. 14 is a view of the outer housing of the waterproof connector according to the second embodiment of the invention which results when it is viewed in a direction indicated by arrows XI, XI shown in FIG. 13.
Figure 15:
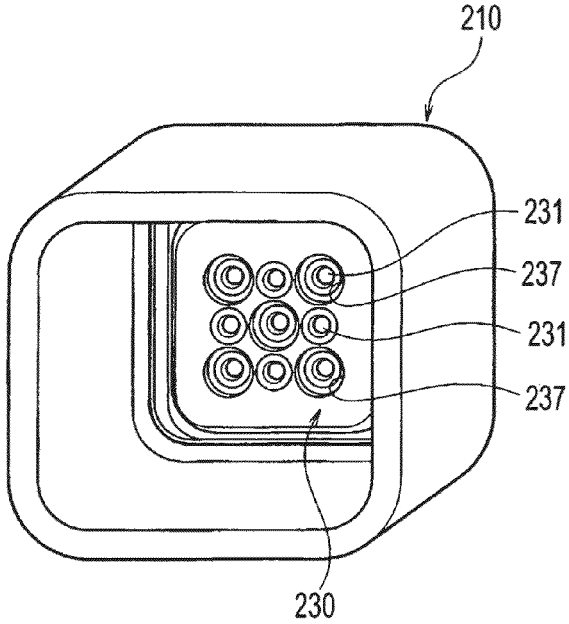
FIG. 15 is a perspective view of the outer housing of the waterproof connector according to the second embodiment of the invention.

As is shown in FIG. 16A to FIG. 18, the mat seal 230 is formed into a thick plate shape having a plurality of through holes 231 into which the terminals 202 attached to the leading ends of the electric wires W are inserted. As is shown in FIGS. 13 to 15, the mat seal 230 is installed between the seal setting surface 228 of the inner housing 220 and the rear wall 212 of the outer housing 210 in a stage prior to the insertion of the terminals 202 into the corresponding terminal accommodation chambers 223. Thereafter, the terminals 202 are inserted into the corresponding terminal accommodation chambers 223 in the inner housing through the insertion holes 213 in the rear wall of the outer housing 210 and the through holes 231 as is indicated by chain double-dashed lines in FIG. 10. In this state, inner circumferential lips 234 each having an angular section which are provided on inner circumferences of the through holes 231 are secured tight to outer circumferences of the electric wires W which extend rearwards of the corresponding terminals 202, so as to seal gaps defined between the electric wires W and the inner housing 220 to thereby prevent the entry of water. Tapered portions 235, 236 are provided at front and rear sides of the inner circumferential lips 234 of the individual through holes 231 so as to enable the smooth insertion of the terminals 202 and the electric wires W.

In the waterproof connector of this embodiment, it is characteristic thereof that the mat seal 230 is molded integrally on a front surface of the rear wall 212 in an interior of the outer housing 210. This will be described in detail later.

As is shown in FIG. 16A to FIG. 18, a circular recess portion 237 (a first positioning member), which is concentric with the through hole 231, is formed in an opening portion in at least one through hole 231 of the plurality of through holes 231 formed in the mat seal 230 on a side of the through hole 231 which faces the securing surface (the front end face 238) to the seal setting surface 228 of the inner housing 220. A frame portion 233 is provided along an outer circumference of the rear end of the mat seal 230 so as to project in an outer circumferential direction along the full circumference thereof. In FIG. 16A to FIG. 18, a portion denoted by reference numeral 239 denotes a gate and an overflow portion which are used during molding.

Figure 10:
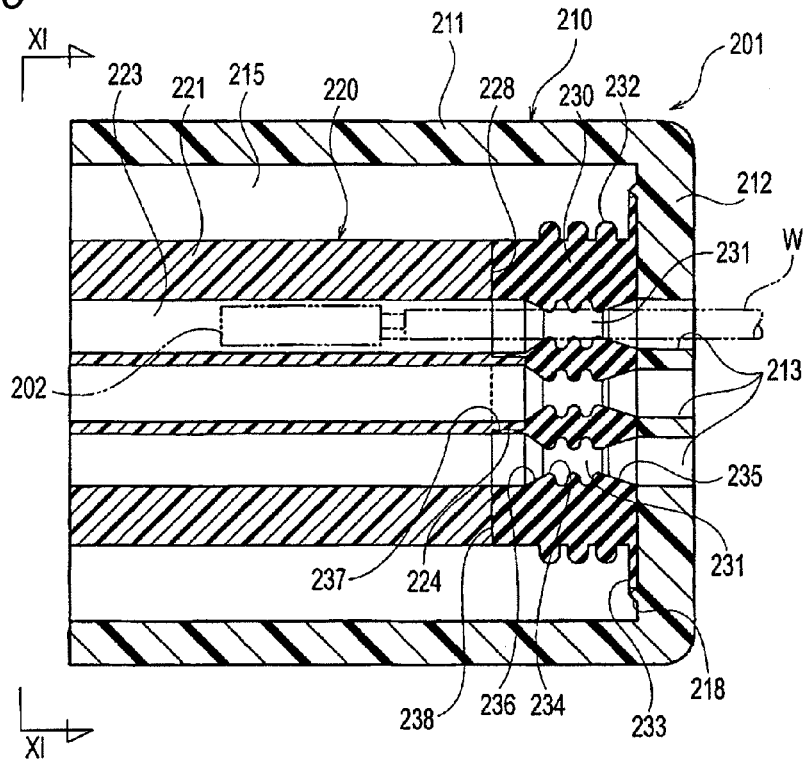
FIG. 10 is a sectional view of the waterproof connector according to a second embodiment of the invention.
Figure 11:
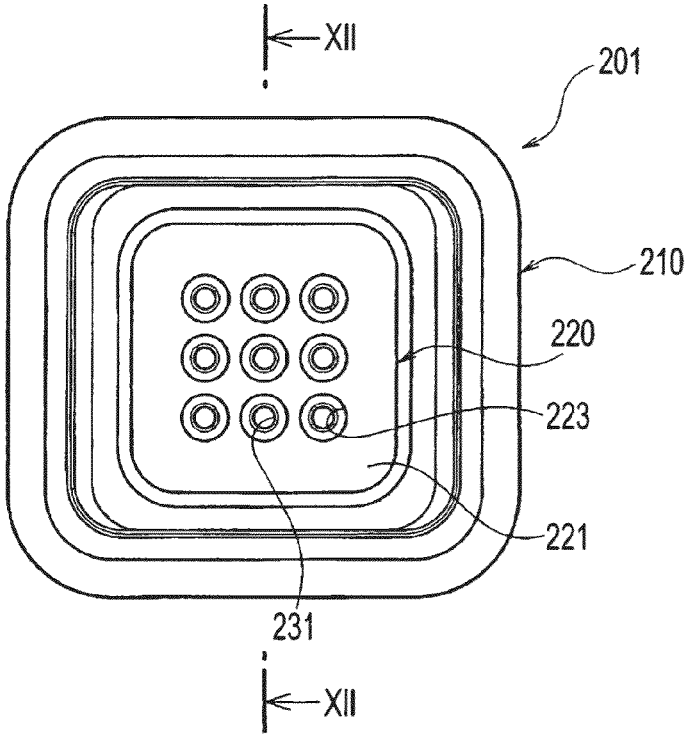
FIG. 11 is a view of the waterproof connector according to the second embodiment of the invention which results when it is viewed in a direction indicated by arrows XI, XI shown in FIG. 10.
Figure 12:
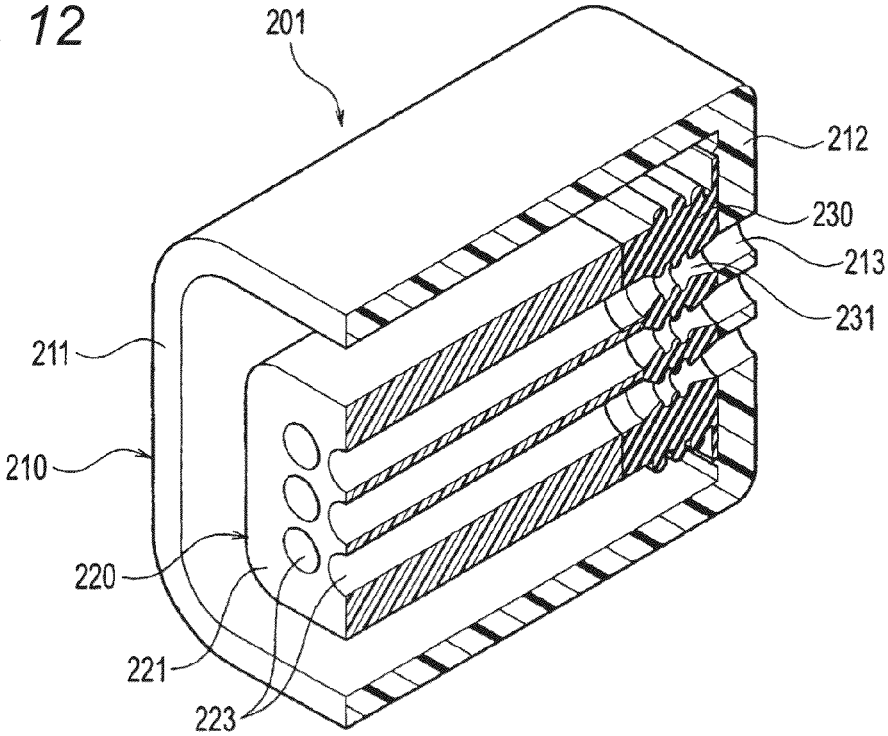
FIG. 12 is a perspective view of the waterproof connector according to the second embodiment of the invention which is taken along the line XII-XII shown in FIG. 11.
Figure 16B:
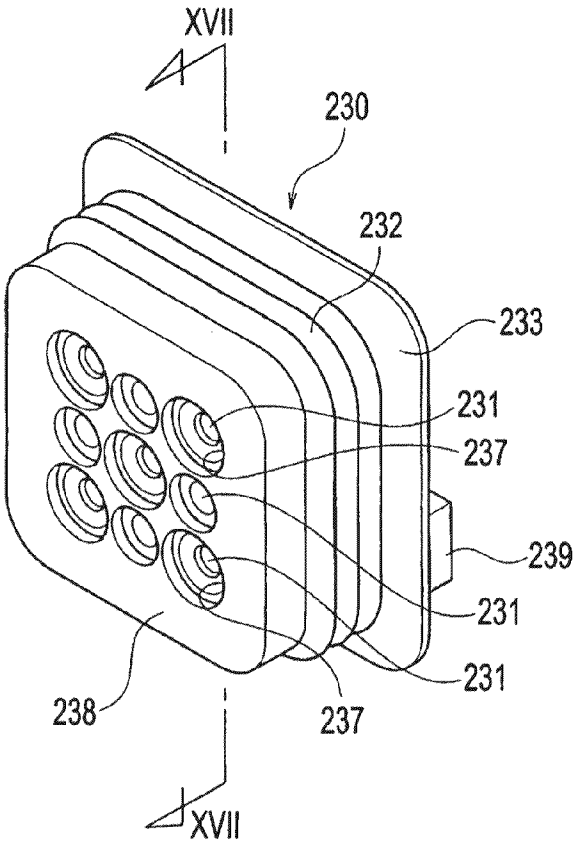
FIGS. 16A and 16B show perspective views of the inner housing and the mat seal according to the second embodiment of the invention which show a relationship therebetween.
Figure 16A:
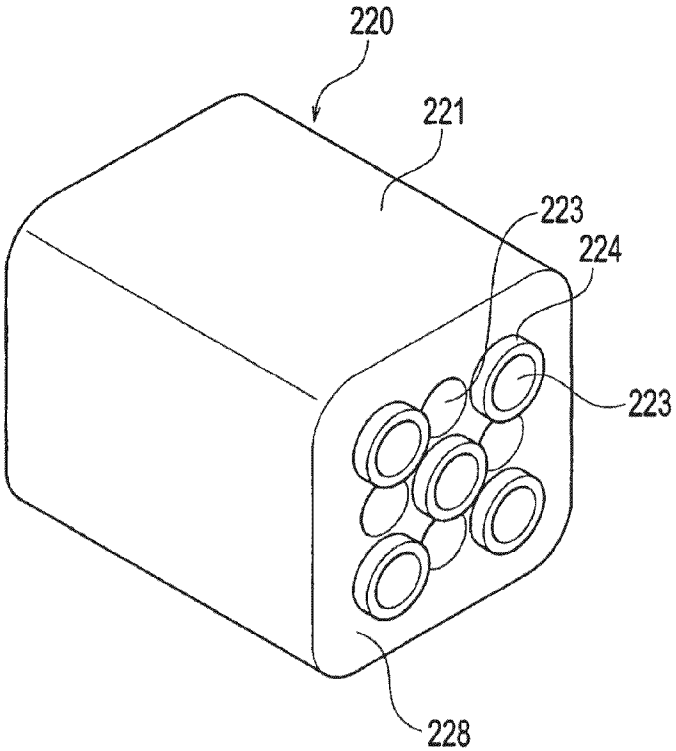
Figure 17:
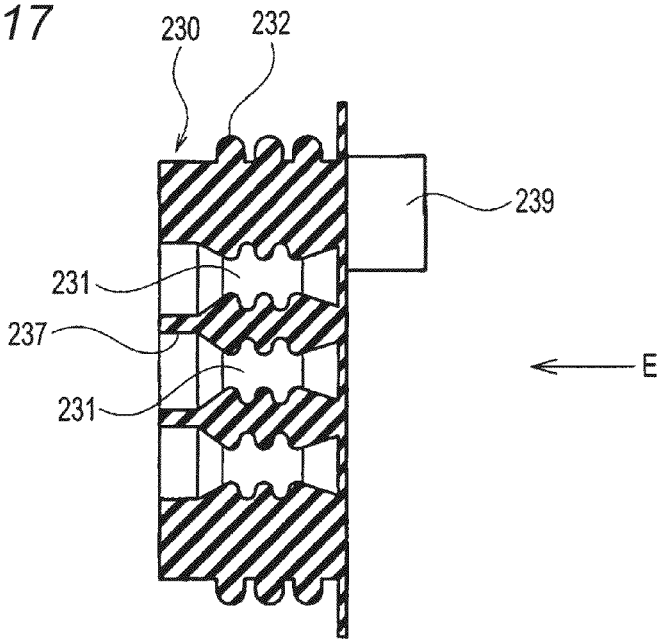
FIG. 17 is a sectional view of the removed mat seal alone according to the second embodiment of the invention taken along the line XVII-XVII and viewed in a direction indicated by arrows shown in FIG. 16B.
Figure 18:
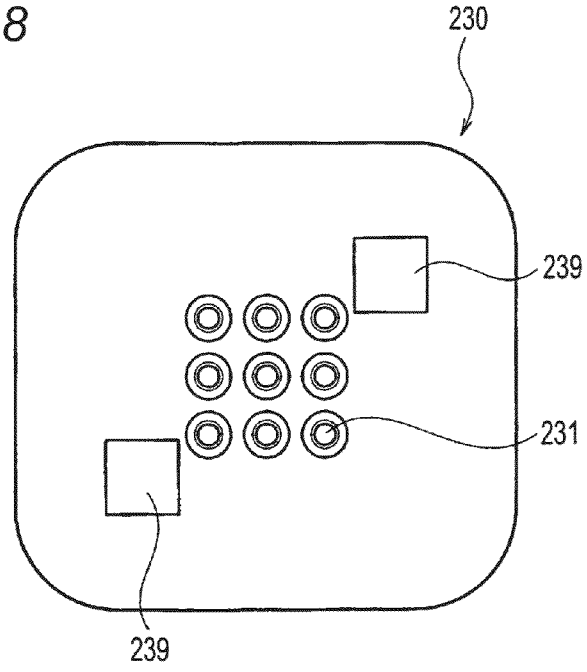
FIG. 18 is a rear end view of the mat seal according to the second embodiment of the invention.
Figure 19:
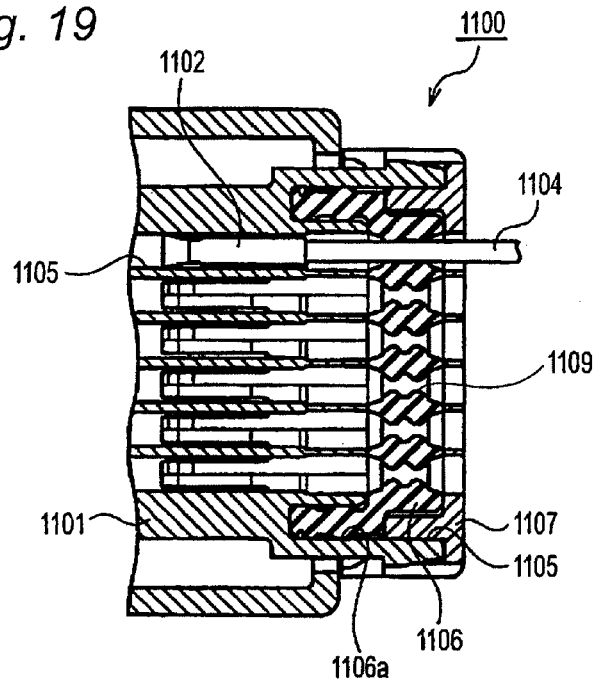
FIG. 19 is a sectional view of a first conventional connector housing.
Figure 20:
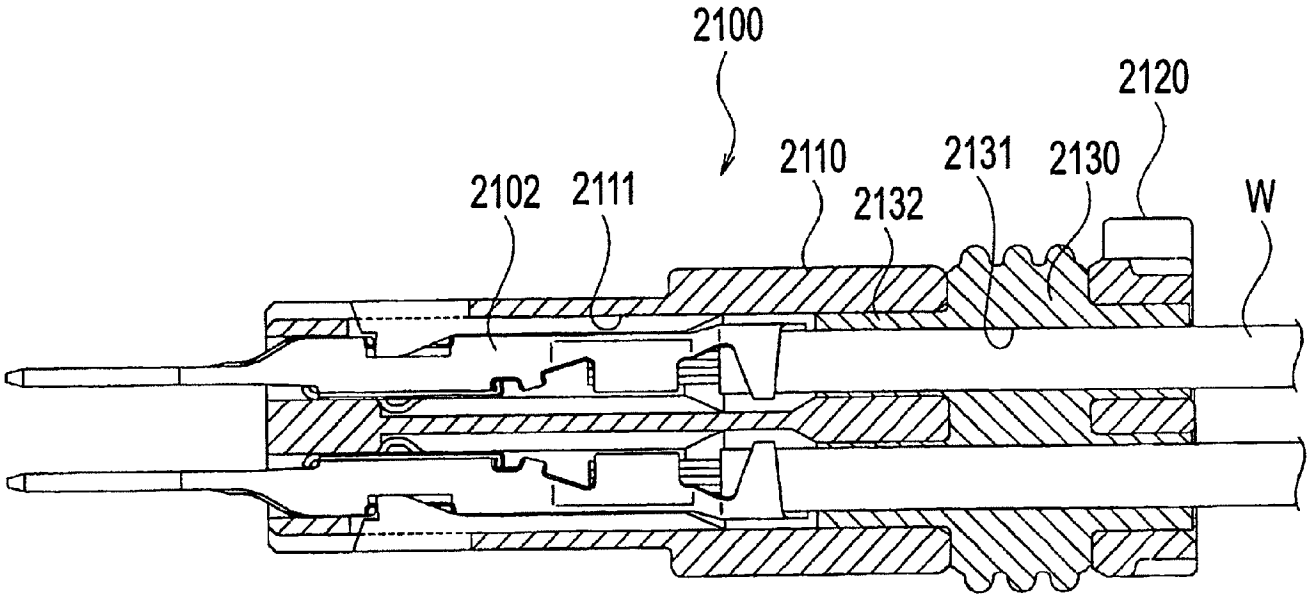
FIG. 20 is a sectional view of a second conventional connector housing.

In addition, as is shown in FIG. 10 and in FIGS. 16A and 16B, a cylindrical projecting portion 224 (a second positioning member), which is adapted to fit in the circular recess portion 237 in the mat seal 230, is formed on the periphery of an opening portion which is opened in the seal setting surface 228 of the terminal accommodation chamber 223 of the terminal accommodation chambers 223 in the inner housing 220 which corresponds to the through hole 231 in which the circular recess portion 237 is formed.

Note that a cylindrical projecting portion may be formed on the periphery of the through hole 230 formed in the mat seal 230, while a circular recess portion may be formed on the periphery of the opening surface of the terminal accommodation chamber 223 in the inner housing 220.

In addition, the shape of the projecting portion 224 is not limited to the cylindrical shape but may be a cylindrical shape having a polygonal section, polygonal prism shape, a circular cone shape, a polygonal pyramid shape, semi-spherical shape or the like. The shape of the recess portion is not limited to the circular shape but may be any shape which corresponds to the shape of the projecting portion 224.

An inner circumference of the cylindrical projecting portion 224 is formed so as to be continuous with an inner circumference of the terminal accommodation chamber 223 in a smooth fashion and is also formed so as to be continuous with the through hole 231 in the mat seal 230 in a smooth fashion when the cylindrical projecting portion 224 is fitted in the circular recess portion 237.

In addition, in this waterproof connector 201, the through holes 231 in the mate seal 230, the terminal accommodation chambers 223 in the inner housing 220 and the insertion holes 213 in the outer housing 210 are aligned into straight lines in vertical and horizontal rows at a constant pitch, and as is shown in FIGS. 14 to 16, the cylindrical projecting portions 224 and the circular recess portions 237 are formed in the vertical direction and the horizontal direction in every other fashion into an array of a zigzag. Namely, the plurality of circular recess portions 237 are disposed so as not to lie adjacent to each other, and the plurality of cylindrical projecting portions 224 are disposed so as to correspond to the circular recess portions so disposed.

The inner housing 220 is inserted into an inside of the hood portion 211 of the outer housing 210 after the outer housing 210 and the mat seal 230 are molded integrally and is disposed with an annular insertion space 215 into which a mating connector housing is inserted ensured between the hood portion 210 and itself. Then, the inner housing 220 is disposed with the seal setting surface at the rear end thereof secured tight to the front end face 238 of the mat seal 230.

In addition, outer circumferential lips 232 are formed on an outer circumference of the mat seal 230. The outer circumferential lips 232 are secured tight to an inner circumference of the mating connector housing when the mating connector housing is inserted into the annular insertion space 215 so as to seal a gap defined between the mating connector housing and the inner housing 220 to thereby prevent the entry of water.

Next, an integrally molded construction of the outer housing 210 and the mat seal 230 will be described.

The outer housing 210 is molded through an injection molding in which a molten polyamide resin is poured into a mold. The mat seal 102 is molded through two-color molding (or an insert molding) on the molded outer housing 210 and is tightly secured to an inner surface of the rear wall 212 of the outer housing 210 without any gap formed therebetween by making use of the outer housing 210 as part of the mold.

The mat seal 102 is molded by use of a material having a selective adhesion which exhibits an adhesive force to the polyamide resin of which the outer housing 210 is formed but does not exhibit any adhesive force to a metallic material (chrome steel) of which the injection molding mold is made, and this type of materials are commercially available including the "Polyamide Resin Liquid Silicone Rubber Selective Adhesion Material" (Product No. X-34-1625A/B, hereinafter, referred to as a "selective adhesion material") produced by Shin-Etsu Chemical. Therefore, the mat seal 230 is bonded to an inner surface of an area on the inner surface of the rear wall 212 of the outer housing 210 which is surrounded by a triangular projection 218 (refer to FIG. 10) at the same time as it is molded.

In fabrication of an integral product of the outer housing 210 and the mat seal 230, firstly, a molten polyamide resin is poured into the mold so as to mold the outer housing 210. Following this, when the polyamide resin of the outer housing 210 sets, a mold for molding the inner surface of the rear wall of the outer housing 210 is replaced by a mold for molding the mat seal 230, and the selective adhesion material which is melted is poured into the mold.

Here, a melting point of the polyamide resin of which the outer housing 210 is formed is set to become higher than a melting point of the selective adhesion material, and therefore, there is caused no such situation that the outer housing 210 is melted when the two-color molding is carried out 20 in the procedure described above. In addition, the selective adhesion material exhibits no adhesive force to the metal of which the mold is made, and therefore, the bonded portion between the outer housing 210 and the mat seal 230 is not damaged. Thus, the outer housing 210 and the mat seal 230 are removed from the molds in such a state that the rear end face and the frame portion 233 of the mat seal 230 are bonded to the joining portion on the inner surface of the rear wall 212 of the outer housing 210.

Thus, the outer housing 210 and the mat seal 230 which are molded together are obtained, and thereafter, the inner housing 220 is inserted into the interior of the outer housing 210, and the seal setting surface 228 at the rear end of the inner housing 220 is secured tight to the front end face 238 of the mat seal 230 while fitting the cylindrical projecting portions 224 on the inner housing 220 in the circular recess portions 237 in the mat seal 230.

Following this, the terminals 202 which are attached to the leading ends of the electric wires W are passed through the insertion holes 213 in the outer housing 210 and the through holes 231 in the mat seal 230 to the terminal accommodation chambers 223 in the inner housing 220 and the terminals 202 are individually fixed in place in the corresponding terminal accommodation chambers 223.

As this occurs, the cylindrical projecting portions 224 which are formed on the seal setting surface 228 of the inner housing 220 are fitted in the circular recess portions 237 which are formed in the opening portions of the through holes 231 in the mat seal 230. Therefore, the through holes 231 in the mat seal 230 and the terminal accommodation chambers 223 in the inner housing 220 can be caused to communicate with each other while restricting the occurrence of a positional misalignment therebetween. As this occurs, the circular recess portions 237 on the mat seat 230 side fit on the outer circumferences of the cylindrical projecting portions 224 on the inner housing 220 side. Therefore, even in the event that the mat seal 230 is deformed when the terminals 202 and the electric wires W are passed through the through holes 231 in the mat seal 230, interiors of the cylindrical projections 224 are not affected by the deformation of the mat seal 230, whereby the terminals 220 and the electric wires W can be inserted as deep as the terminal accommodation chambers 223 smoothly while being guided on the inner circumferences of the cylindrical projecting portions 224.

Consequently, being different from the conventional waterproof connector in which the positional misalignment is prevented by inserting the cylindrical portion of the mat seal into the interior of the terminal accommodation chamber, the increase in insertion force generated when the terminals 202 and the electric wires W are inserted can be suppressed. In addition, due to the restriction of the occurrence of a positional misalignment, the mat seal 230 can be prevented from being damaged by the terminals 202 and the electric wires W. Therefore, the water stopping capability can be increased. Additionally, the workability in inserting the terminals 202 can be increased since the terminals 202 and the electric wires W can be inserted smoothly as deep as the terminal accommodation chambers.

In addition, the mat seal 230 is integrated with the outer housing 210 in advance, and therefore, the mat seal 230 can be held in a stable fashion, thereby making it possible to combine smoothly the inner housing 220, the outer housing 210 and the mat seal 230 together.

Following this, a mating connector, not shown, is fitted together with the waterproof connector 201 of this embodiment. Then, the mating connector housing is inserted into the annular insertion space 215 inside the hood portion 211 of the outer housing 210, and at the same time as the mating connector housing is fitted in the inner housing 220, the terminals 202 which are accommodated in the terminal accommodation chambers 223 in the inner housing 220 are fitted together with terminals accommodated in the mating connector housing, whereby the electric wires are connected together.

In the fitted state in which both the connector housings are fitted together, the inner circumferential inner lips 234 of the mat seal 230 are elastically secured tight to the outer circumferences of the electric wires W which are inserted through the through holes 231 in the mat seal 230. Thus, the entry of water or the like into the interior of the inner housing 220 can be prevented in an ensured fashion. In addition, the outer circumferential lips 232 of the mat seal 230 seal the gap between the mating connector housing and the inner housing 220 so as to prevent the entry of water, and therefore, the connecting space in which the terminals in the interior of the mating connector housing and the terminals in the interior of the inner housing 220 are connected together can be sealed so as to prevent the entry of water.

In addition, according to the waterproof connector of this embodiment, the through holes 231 on the mat seal 230 side and the terminal accommodation chambers 223 on the inner housing 220 side can be connected so as to be continuous with each other without any step formed therebetween. Therefore, the terminals 202 and the electric wires W can be inserted smoothly.

Additionally, the cylindrical projecting portions 224 and the circular recess portions 237 are provided in the vertical direction and the horizontal direction in the every other fashion into the array of a zigzag. Therefore, the terminal accommodation chambers 223 can be arranged with the narrow pitch while avoiding interference between the circular recess portions 237 and the cylindrical projecting portion 224 which lie adjacent to each other, and this arrangement of the cylindrical projecting portions and the circular recess portions can contribute to the reduction in size of the connector.

In addition, the first housing is configured as the outer housing 210 having the hood portion 211, and the second housing is configured as the inner housing 220 which is protected inside the hood portion 211. Therefore, the fitting of the mating connector housing into the inner housing 220 can be implemented smoothly.

While the invention has been described in detail or by reference to the specific embodiments, it is obvious to those skilled in the art to which the invention pertains that various modifications can be made thereto without departing from the spirit, scope and intent of the invention.

The invention is based on Japanese Patent Application No. 2009-038101 filed on Feb. 20, 2009 and Japanese Patent Application No. 2009-117649 filed on May 14, 2009, the entire contents of which are to be incorporated herein by way of reference.

INDUSTRIAL APPLICABILITY

There can be provided the waterproof connector which can prevent the entry of water into the interior of the connector housing, which can suppress the increase in insertion resistance of the terminals and which can realize an increase in working efficiency with which the metal terminals and the electric wires are inserted into the connector housing.

REFERENCE SIGNS LIST

101, 101*a* connector housing
102, 102*a* mat seal
111 inner joining surface
112 insertion hole
112*a* inner circumferential surface
112*b* large diameter portion
121 rear end face (end face)
122 insertion portion
122*a* collar portion
123 insertion hole
201 waterproof connector
202 terminal
210 outer housing (first housing)
211 hood portion
212 rear wall
213 insertion hole
215 annular insertion space
220 inner housing (second housing)
223 terminal accommodation chamber
224 cylindrical projecting portion
228 seal setting surface
230 mat seal
231 through hole
232 outer circumferential lip
234 inner circumferential lip
237 circular recess portion
238 front end face
W electric wire

The invention claimed is:

1. A waterproof connector comprising:

a first housing having an accommodation chamber for accommodating a terminal attached to an electric wire and a rear wall which defines a part of the accommodation chamber and has at least one insertion hole; and a seal member formed integrally with the first housing, formed of an elastic material to be secured tight to an outer circumference of the electric wire, wherein the seal member includes:

a main body portion disposed in the accommodation chamber of the first housing, a rear end face of the main body portion bonded to the rear wall of the first housing, a frame portion which extends from the rear end face so as to extend along an outer circumferential edge of the rear end face and protrude outward from the main body portion, the frame portion bonded to the rear wall of the first housing, and a terminal hole formed at least partially in the main body portion, which is configured to accept the terminal therethrough.

2. The waterproof connector as set forth in claim 1, wherein the seal member is formed of a selective adhesion material which exhibits an adhesive force to a material of the first housing and exhibits no adhesive force to a material of which a mold is made, and the seal member is molded through two-color molding with the first housing or insert molding relative to the first housing, by using the mold.

3. The waterproof connector as set forth in claim 1, wherein the rear end face and the frame portion of the seal member are bonded to an inner surface of the rear wall which faces the accommodation chamber, an insertion portion projects from the rear end face and away from the main body portion, and an outer circumferential surface of the insertion portion is bonded to an inner circumferential surface of the insertion hole of the first housing.

4. The waterproof connector as set forth in claim 1, wherein the seal member further includes an integrally formed insertion portion that extends rearward from the rear end face of the seal member, the insertion portion has an integrally formed flange portion which extends from an outer circumferential surface of the insertion portion, and is bonded to an inner circumferential surface of the insertion hole of the first housing and is bonded to an outer surface of the rear wall which is opposite to an inner surface of the rear wall, so that a portion of the rear wall is disposed between the rear end face and the flange portion of the seal member.

5. The waterproof connector as set forth in claim 1, further comprising:

a second housing having a seal setting surface which is formed with a plurality of accommodation holes and which faces the rear wall of the first housing, wherein the insertion hole of the first housing is a plurality of insertion holes, and the plurality of insertion holes correspond to the accommodation holes, configured to accommodate a plurality of terminals, wherein the seal member is interposed between the rear wall and the seal setting surface and has a front end face which is brought into contact with the seal setting surface, the front end face is formed with a plurality of through holes respectively communicating with the accommodation holes and the insertion holes, and the seal member further includes a first positioning member located at at least one of the plurality of through holes in front end face, and wherein the second housing has a second positioning member located at one of the accommodation holes which corresponds to said at least one of the plurality of through holes of the seal member, and which is brought into engagement with the first positioning member of the seal member.

6. The waterproof connector as set forth in claim 5, wherein the plurality of accommodation holes and the plurality of through holes are aligned at constant intervals on straight lines in a plurality of rows, there are a plurality of first positioning members and one of the first positioning members is disposed so as not to be adjacent to another first positioning member, and the second positioning member is disposed so as to correspond to the plurality of first positioning members.

7. The waterproof connector as set forth in claim 5, wherein the first positioning member is a circular recess portion concentric with said at least one of the plurality of through holes, and the second positioning member is a cylindrical projecting portion located at said one of the accommodation holes and fits in the corresponding first positioning member.

8. The waterproof connector as set forth in claim 7, wherein an inner circumferential surface of the projecting portion is continuous with an inner circumferential surface of the accommodation hole on which the projecting portion is provided and an inner circumferential surface of the through hole which communicates with the accommodation hole.

9. The waterproof connector as set forth in claim 5, wherein the accommodation chamber is defined by the rear wall and a hood portion which extends from an outer circumferential edge of the rear wall and which has a cylindrical shape, wherein the second housing is disposed so as to define an annular space between an outer circumferential surface of the second housing and an inner circumferential surface of the hood portion, and wherein a projection is provided on an outer circumference of the seal member so as to be secured tight to a housing of a mating connector which is inserted into the annular space.

10. A waterproof connector comprising:

a first housing having an accommodation chamber for accommodating terminals attached to electric wires and a rear wall which defines a part of the accommodation chamber and has insertion holes;

a seal member, having terminal holes into which the terminals are inserted, formed integrally with the first housing, formed of an elastic material to be secured tight to an outer circumference of the electric wires; and a second housing having a seal setting surface which is formed with a plurality of accommodation holes into which the terminals are accommodated and which faces the rear wall, wherein the insertion holes correspond to the accommodation holes, wherein the seal member is interposed between the rear wall and the seal setting surface and has a front end face which is brought into contact with the seal setting surface, the front end face is formed with through holes respectively communicating with the accommodation holes and the insertion holes, and a first positioning member is located at at least one of the through holes in the front end face, wherein the second housing has a second positioning member, located at one of the accommodation holes which corresponds to said at least one of the through holes of the seal member, and which is brought into engagement with the first positioning member, wherein the first positioning member is a circular recess portion, and wherein the second positioning member is a cylindrical projecting portion and fits in the corresponding first positioning member.

11. The waterproof connector as set forth in claim 10, wherein the accommodation holes and the through holes are aligned at constant intervals on straight lines in a plurality of rows, the first positioning member is disposed so as not to be adjacent to another first positioning member, and the second positioning member is disposed so as to correspond to the first positioning member and another first positioning member.

12. The waterproof connector as set forth in claim 10, wherein an inner circumferential surface of the projecting portion is continuous with an inner circumferential surface of the accommodation hole on which the projecting portion is provided and an inner circumferential surface of the through hole which communicates with the accommodation hole.

13. The waterproof connector as set forth in claim 10, wherein the accommodation chamber is defined by the rear wall and a hood portion which extends from an outer circumferential edge of the rear wall and which has a cylindrical shape, wherein the second housing is disposed so as to define an annular space between an outer circumferential surface of the second housing and an inner circumferential surface of the hood portion, and wherein a projection is provided on an outer circumference of the seal member so as to be secured tight to a housing of a mating connector which is inserted into the annular space.

14. A waterproof connector comprising:

a first housing having an accommodation chamber for accommodating terminals attached to electric wires and a rear wall which defines a part of the accommodation chamber and has one insertion hole; and a seal member, having a plurality of terminal holes into which the terminals are inserted, formed integrally with the first housing, formed of an elastic material to be secured tight to an outer circumference of the electric wire, wherein the seal member has a rear end face which is bonded to an inner surface of the rear wall which faces the accommodation chamber and an insertion portion which projects from the rear end face, and the insertion portion is bonded to an inner circumferential surface of the insertion hole.

15. The waterproof connector as set forth in claim 14, wherein the seal member is formed of a selective adhesion material which exhibits an adhesive force to a material of the first housing and exhibits no adhesive force to a material of which a mold is made, and the seal member is molded through two-color molding with the first housing or insert molding relative to the first housing, by using the mold.

16. The waterproof connector as set forth in claim 14, wherein the insertion portion has an integrally formed flange portion which extends from an outer circumferential surface of the insertion portion, and is bonded to an inner circumferential surface of the insertion hole of the first housing and is bonded to an outer surface of the rear wall which is opposite to the inner surface thereof.

* * * * *